US011484747B2

(12) United States Patent
Bartley

(10) Patent No.: US 11,484,747 B2
(45) Date of Patent: Nov. 1, 2022

(54) PORTABLE DOOR MOUNTED EXERCISE APPARATUS

(71) Applicant: Marc Bartley, Columbia, SC (US)

(72) Inventor: Marc Bartley, Columbia, SC (US)

( * ) Notice: Subject to any disclaimer, the term of this patent is extended or adjusted under 35 U.S.C. 154(b) by 76 days.

(21) Appl. No.: 17/130,406

(22) Filed: Dec. 22, 2020

(65) Prior Publication Data

US 2022/0193484 A1 Jun. 23, 2022

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 21/00*** | (2006.01) |

(52) U.S. Cl.

CPC ..... *A63B 21/1645* (2013.01); *A63B 21/0442* (2013.01); *A63B 21/0557* (2013.01); *A63B 21/154* (2013.01); *A63B 21/4035* (2015.10); *A63B 2210/50* (2013.01)

(58) Field of Classification Search

CPC ..... A63B 21/1645; A63B 21/0442; A63B 21/0557; A63B 21/154; A63B 21/4035; A63B 2210/50; A63B 21/16–1681; A63B 21/153–156

See application file for complete search history.

(56) References Cited

U.S. PATENT DOCUMENTS 5,254,065 A 10/1993 Pollock
5,468,205 A * 11/1995 McFall ..... A63B 21/169 482/904
5,601,518 A 2/1997 Weintraub
5,807,214 A 9/1998 Riazi
6,059,698 A 5/2000 Mazor
6,322,483 B1 * 11/2001 Rotella ..... A63B 21/1654 482/121
6,662,651 B1 12/2003 Roth
6,908,418 B2 6/2005 Saure
7,976,445 B2 7/2011 Lalaoua
8,083,653 B2 12/2011 Hetrick
8,821,359 B1 * 9/2014 Kassel ..... A63B 21/0557 482/904
D742,461 S * 11/2015 Baldwin ..... D21/662
D930,092 S * 9/2021 Everett ..... D21/682
2003/0158024 A1 * 8/2003 Saure ..... A63B 21/1645 482/129
2007/0173383 A1 7/2007 Feigenbaum et al.
2011/0177921 A1 7/2011 Olson et al.
(Continued)

*Primary Examiner* — Jennifer Robertson
*Assistant Examiner* — Catrina A Letterman
(74) *Attorney, Agent, or Firm* — Southeast IP Group; Thomas L. Moses

(57) ABSTRACT

A portable door mounted exercise apparatus includes a removable strap mount assembly for attachment to a door, and a cable/pulley assembly that includes handles for pulling the cable to stretch a resistance band that is affixed to the strap mount assembly. The lower portion of the resistance band is secured to the bottom of the strap at an anchor point via a carabiner or clip, so that when a user pulls on the handles, either downwardly or outwardly, for instance, the resistance band is stretched, thereby providing resistance for purposes of exercise. When not in use, the portable door mounted exercise apparatus may be removed from the door, disassembled, and the straps can be folded or rolled up for purposes of storage and/or transport.

3 Claims, 5 Drawing Sheets

(56) References Cited

U.S. PATENT DOCUMENTS

| | | | | |
|---|---|---|---|---|
| 2014/0005015 | A1 | 1/2014 | Hester | |
| 2014/0155229 | A1 | 6/2014 | Nikkaran | |
| 2014/0315695 | A1 | 10/2014 | Scott | |
| 2015/0031512 | A1* | 1/2015 | Schleiden, II ..... | A63B 21/0442<br>482/139 |
| 2018/0036575 | A1 | 2/2018 | Rawlins | |
| 2020/0338388 | A1* | 10/2020 | Albert Garcia .. | A63B 21/00069 |

* cited by examiner

PORTABLE DOOR MOUNTED EXERCISE APPARATUS

BACKGROUND OF THE INVENTION

The present invention relates generally to a portable exercise apparatus removably mounted over a door and used for physical fitness exercises. More specifically, the present invention includes a strap that loops over a door and a pulley system with means for attaching various handle systems along with resistance bands.

Over-the-door exercise apparatuses have been used as workout tools for many years by users who like to work out at home or while traveling. Typically, exercise apparatuses that are mounted on a door do not include a pulley system along with the combination of being able to interchange different handles and resistance bands.

The following documents show examples of over-the-door exercise systems that have been developed over the years, and each of the following references are incorporated herein by reference, in their entireties:

U.S. Pat. No. 5,254,065 Flexible Loop Fastening Strap Supportable in Door Structure A fastening strap configured as a loop is secured between a door and its associated frame to provide structure for attachment of exercise or physical therapy equipment to the door structure for support. The fastening strap is formed from a flexible elongate strip of webbing with an enlarged end portion which in a first species comprises a rolled portion of the first end portion of the webbing material and in a second species is a separate resiliently deformable element. The webbing strip extends from the enlarged end portion to form a loop and pass back over the enlarged end portion for fastening of the second end to the loop portion of the strip. The second end and adjacent the strips forming the loop are fastened to each other spacedly adjacent the enlarged end portion. A flexible coating is provided on a portion of the outer surface of one strip portion forming the loop to provide a higher frictional surface to contact a supporting door structure and to protect the strip from physical damage from the supporting door structure.

U.S. Pat. No. 5,468,205 Portable Door Mounted Exercise Apparatus

An exercise apparatus is disclosed having a pair of pulley support units mounted on a door by straps which vertically encircle the door. The support units are interconnected by a series of elastic bands, such as bungee cords that run vertical paths between the support units. The ends of the bands or cords are wrapped around pulleys and terminated such that a handle may be attached to each of the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

U.S. Pat. No. 5,601,518 Portable Exercise Device

A portable exercise device that is usable in the home by attachment to supporting structure. The device comprises a pair of bases that are configured for attachment to a support, a member having a peripheral edge being pivotally attached to the other base. One end of the bar is attached to the base to which the member is attached by a resistance mechanism. To the other end of the bar is attached a strap that engages a portion of the peripheral edge of the member and extends therefrom for attachment to a grip. This structure reduces the resistance force produced by the resistance mechanism as the exerciser approaches full contraction of the muscle group being exercised to ensure a completely full contraction is made. The device also compensates for the use of a non-linear resistance mechanism. In addition the resistance provided by the device is easily adjustable, providing the appropriate resistance for the particular muscle group being exercised.

U.S. Pat. No. 5,807,214 Connector for Securing an Exercise Member

A connector for securing an exercise member to a section of flexible material includes a slide and first and second cinchable loops. First and second cinchable loops are formed in the material and in cooperation with the slide and are connected by a third loop. The third loop has a first end and a second end that are restrained by a restraint. The restraint prevents the first and second cinchable loops from pulling out of the frame. The connector secures an exercise member by holding, the exercise member in the two cinchable loops. The connector may also be used to anchor an exercise member to a door, a door hold, or a hand hold. Multiple connectors may also be used in conjunction with a single section of material to provide additional and varying exercise device configurations.

U.S. Pat. No. 6,059,698 Exercise Device for Removable Mounting on a Door

The exercise device includes a pair of U-shaped brackets that are mounted on the top and bottom edges of the door. Suspended between the brackets are a plurality of elastic cords of different elasticities. By selecting different cords, different tensions or resistances can be obtained for exercise routines. An ankle strap may be used to exercise the leg muscles. In some versions, spacers may be provided between the U-shaped brackets and the door to prevent rocking.

U.S. Pat. No. 6,322,483 Adjustable Strap and Band Exercise Device Mountable on Door A portable and light weight exercise device comprising an adjustable nylon strap which has a series of nylon loops along one side, that side being of a length equal to the height of a door, and the adjustable nylon strap having affixed thereto on the side opposite the side having the nylon loops, a locking mechanism that allows for adjustment of the length of the adjustable nylon strap so that the adjustable strap may be positioned to encircle the height of the door. An elastic band is passed through a selected loop in the series of loops on the adjustable nylon strap. The user pushes or pulls the elastic band passed through a loop to exercise a wide range of muscles.

U.S. Pat. No. 6,662,651 Portable Exercise Device

A portable exercise device having a force measuring system and a length adjuster. The exercise device includes a pulley/securing device assembly and a cord having a gripping structure at each of its ends. The pulley/securing device assembly has a pulley for engaging the cord and a securing device for securing the exercise device to a door. The force measuring system engages one of the gripping structures and determines magnitude of a tensile force applied to that gripping member. The force measuring system is in communication with an electronic display that displays the magnitude of the tensile force to a user. The force measuring system may be powered by batteries contained in the housing of the force measuring system, contained in a handgrip of the gripping structure, or located aboard the electrified glove, may be powered by a power generating system driven by the pulley during, or may be powered by a piezoelectric sensor used to measure the force applied to the cord. The length adjuster includes a body having a plurality of slots that threadedly receive a portion of the cord and allow a user to create, and adjust the size of, an excess loop to change the effective length of the cord.

U.S. Pat. No. 6,908,418 Door Mounted Deadman for Exercise Devices

A door-mounted strap extends around a door in the vertical direction, typically being placed medially of the door. On the deadman side of the door, the strap is continuous as it faces the exerciser. On a face of the door, away from the exerciser, the strap has a tension-locking clamp, typically a ladder lock, enabling the tightened door-mounted strap to snugly surround the door. Extending from the door top to the door bottom on exerciser's side of the door is a back-mounting strip that exceeds in width and underlies the door-mounted strap. This back-mounting strip is sewn at intervals to enclose the horizontally disposed linear back members of D-rings at approximate 10-inch intervals. Removable and attachable elastic members are provided for fastening to the arcuate portions of the D-rings. These D-rings and elastic members are provided in combination with handholds, limb straps, at the like to enable standing, sitting or prone exercise positions between the D-rings at the deadman and the exerciser.

U.S. Pat. No. 7,976,445 Door Mounted Gym

A portable door mounted exercise system that can be easily set up and taken down and which doesn't occupy any significant floor space. The system provides variable resistance for aerobic, cardiovascular and muscle building exercises. Variable resistance is provided through a set of elastic cords. A user can select to use any combination of the cords to provide a desired level of resistance for exercise and training. The cords can be attached to a handle, ankle strap, squat strap or neck strap depending on the type of exercise or training desired by the user. The cords can be attached to a pulley system and bracket which is slidably attached to a door mount to provide variable positioning for the pulley system. The system can also include a training computer to provide auto and video training information to the user.

U.S. Pat. No. 8,083,653 Exercise Device Having a Door Anchor

An exercise device having a door anchor is described. The anchor is fixed to a pair of elongated members each having a grip. The anchor stands off from the door by 1 to 18 inches before attaching to the elongated members. In one embodiment, the exercise device is sewn together. In another embodiment, a ring holds the various components together.

US Application No. 2007/0173383 Portable Exercise Apparatus

An exercise apparatus includes an elongated strap provided with a fastener device fixed thereon for connection to a selected portion of the strap to form a closed loop of the strap, a grip member adapted for attachment to the strap and slidable along the strap, a support strip connected at a first end thereof to the strap and having at a second end thereof a connector portion, and a mounting member disposed on the connector portion of the support strip, the mounting member defining a body of greater thickness than the support strip.

US Application No. 2011/0177921 Door Mounted Exercise Devices and Systems

Systems, assemblies, and devices for mounting an exercise apparatus to a door. More particularly, an exercise system is mounted to opposing corners of a door and directed diagonally across a door. A bracket engages the door corner and is oriented to directed tension members of the exercise system at a diagonal across a front surface of the door. The bracket includes a door mount for coupling the bracket to four surfaces of the door. The bracket includes an exercise device mount adapted to couple to tension members, pulleys, or other exercise devices. The exercise device mount defines a mounting axis that is non-parallel and non-perpendicular relative to a top edge surface of the door.

US Application No. 2014/0005015 Portable Gym Using Gravitational Forces

A portable gym using gravitational forces of the present invention includes a gravity gym assembly and a belt harness. The gravity gym assembly includes a door anchor that is attachable to any doorway having a door, and an adjustable strap that leads to a pulley through which a cable passes. The cable is equipped with detachable handles on each end and may be advanced back and forth through the pulley when forces are applied to the handles. A series of exercises may be accomplished by varying body position, and exercises the entire body by using the person's body weight for resistance. In an alternative embodiment, the portable gym using gravitational forces may include attachment of the cable ends to the belt harness worn around the waist of the athlete and provides for the stabilization and application of resistance on the body while exercising. Exercises that are primarily performed in the gym, including, strengthening shoulder, arm, chest, back, leg, and abdominal core muscle groups, and performing cardiovascular and plyometric movements, can be performed virtually anywhere using the portable gym using gravitational forces of the present invention.

US Application No. 2014/0155229 Exercise Apparatus

An exercise apparatus includes a mounting assembly and a pulley assembly coupled to the mounting assembly. The pulley assembly includes a first pulley and a second pulley. A first pulley cable is positioned about the first pulley for movement relative thereto and a second pulley cable is positioned about the second for movement relative thereto. The first pulley cable includes a first end and a second end and the second pulley cable includes a first end and a second end. A first handle is coupled to the first end of the first pulley cable and a second handle is coupled to the first end of the second pulley cable and the second end of the second pulley cable.

US Application No. 2014/0315695 Body Stretching Assembly

A body stretching assembly is provided. The assembly comprises a pulley, a plurality of body attachment straps, and a rope. The pulley comprises a securing end and a wheeled end, wherein the securing end includes a frame having a proximal aperture, a protrusion, and a pair of distal legs with fastening apertures. The proximal aperture is configured for connection with a pulley assembly supporting structure, such as a door jam or an exposed support such as a pole. A user threads a rope over the pulley wheel to begin treatment. One end of the rope comprises a hand attachment, whereas the opposing rope end includes one of a head, hand, or ankle attachment. The user pulls one end of the rope, thereby causing the opposing end to pull on the body of a user. Gradual actuation of the rope end provides a stretching exercise to a user.

US Application No. 2018/0036575 Portable Exercise Equipment

A portable exercise device includes an anchor portion, a swivel portion, one or more elongate straps, springs or elastic cords, and handles. The swivel portion may allow the elongate straps to rotate without getting tangled. The springs may be placed in series or in parallel with at least part of the elongate straps. Two or more springs, of different lengths, may be placed in parallel to achieve a changing spring constant of the system, depending on displacement of the handle.

BRIEF SUMMARY OF THE INVENTION

In accordance with one aspect of the invention, a first embodiment of a portable exercise apparatus for mounting on a door includes a strap which loops around a door, and a cable apparatus that is attached to one or more resistance bands for the purpose of resistance training.

The strap is formed by the combination of a front strap and a back strap. The front strap is preferably wider than the back strap to protect the door from any damage caused by the moving components of the apparatus. The strap includes a stop member which, when the door is closed, prevents the portable exercise apparatus from rotating about the door while the apparatus is in use. The bottom portion of the front strap and the bottom portion of the back strap both include complementary sides of attachment means, preferably a hook and loop fastening material which is used to attach the front strap and back strap in a removable manner. An anchor point, preferably fabric folded back on itself to form a loop, is disposed at the top portion of the front strap, and in a preferred embodiment, a pulley is attached to the anchor point using any suitable attachment means, such as a carabiner, O-ring, D-ring, or the like.

In a preferred embodiment, a cable includes a carabiner for removable attachment of one or more handle members on a first end, and includes a second carabiner attached to a second end thereof. The cable runs through the pulley so that the handle members hang freely, while the carabiner on the second end of the cable is attached to a stretchable resistance band. The anchor point disposed at the bottom portion of the front strap may also include a third carabiner, and the bottom portion of the stretchable resistance band is removably attached thereto. Various handle systems can be removably attached to the free, first end of the cable. It should be understood that different resistance bands may be used, either interchangeably or together at the same time, in order to vary the level of resistance provided by the exercise apparatus. Exercises may include tricep, back, bicep, and upper back exercises. Other types of exercises may be employed, as well.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Overview

Figure 1:
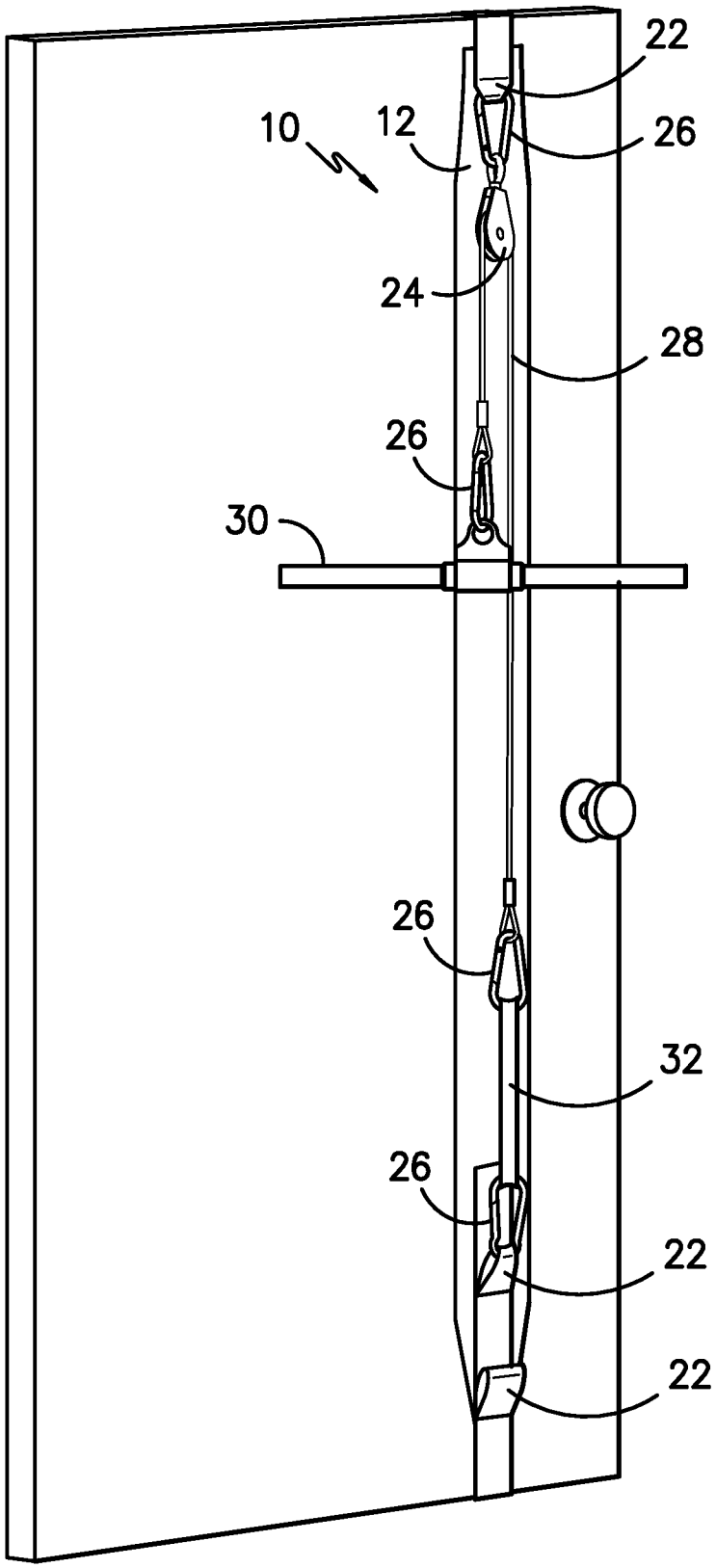
FIG. 1 is a perspective view of one embodiment of a portable door mounted exercise apparatus mounted on a door, wherein the exercise apparatus includes a front strap, back strap, a pulley and cable assembly, a handle, and resistance bands.

The present invention includes, in a first embodiment, a portable exercise apparatus for mounting on a door, as shown in FIGS. 1-5. Essentially, the portable door mounted exercise apparatus includes a removable strap mount assembly for attachment to a door, and a cable/pulley assembly that includes handles for pulling the cable to stretch a resistance band that is affixed to the strap mount assembly. The lower portion of the resistance band is secured to the bottom of the strap at an anchor point via a carabiner or clip, so that when a user pulls on the handles, either downwardly or outwardly, for instance, the resistance band is stretched, thereby providing resistance for purposes of exercise. When not in use, the apparatus may be removed from the door, disassembled, and the straps can be folded or rolled up for purposes of storage and/or transport.

Strap Mount Assembly

The strap mount mechanism includes a front strap 12 (such as nylon straps marketed under the trade name Cordura® by Invista North America, for instance), and a back strap 14. The front strap 12 is preferably wider than the back strap 14 in order to protect the door from damage caused by the moving components of the apparatus. The top portion of the front strap 12 and the top portion of the back strap 14 are secured together, preferably by stitching, although other attachment means may be used. The bottom portion of the back strap 14 includes an attachment means 16, preferably a section of hook and loop fastener, and the bottom portion of the front strap 12 includes a complementary side of the attachment means 18, such as the complementary side of a hook and loop fastener, so that the front and back straps may be removably connected to one another when the strap is looped around a door in a vertical orientation. Other attachment means may be used to attach the lower portions of the front and back straps together, including snaps, buttons, or the like. The back strap 14 includes a stop member 20, which is preferably a rolled and tacked portion of strap material, disposed on the strap mount assembly adjacent the slot between the door and door frame to prevent the portable exercise apparatus 10 from sliding out of place when the door is closed and the portable exercise apparatus 10 is in use. It should be understood that the stop member may be attached to the device in any suitable manner, so long as it prevents rotation of the straps about the door when pressure is applied to the handle members.

Figure 2:
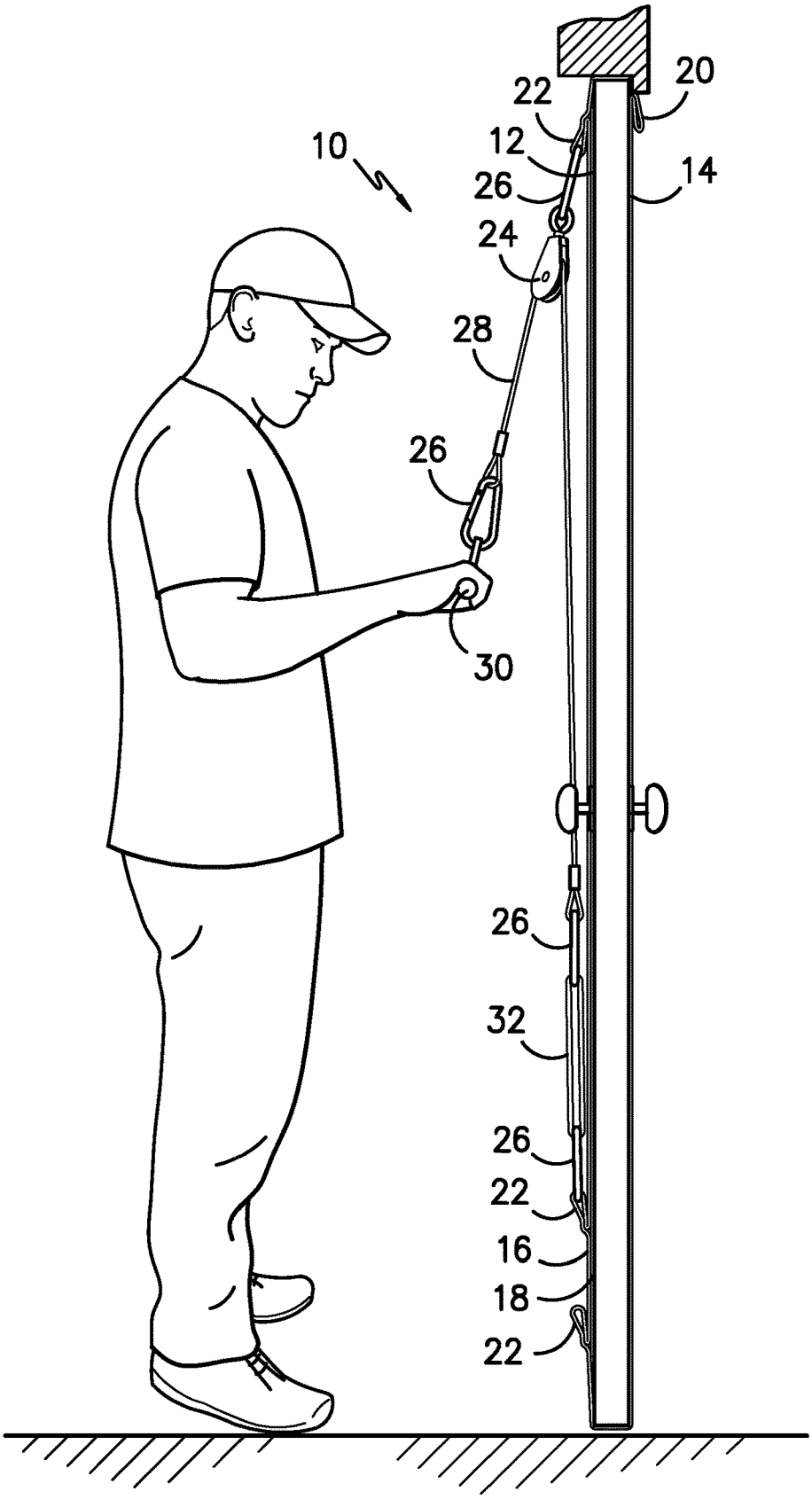
FIG. 2 is a side view of one embodiment of a portable door mounted exercise apparatus in use by a user, showing a handle being pulled downwardly and engaging the resistance bands.
Figure 3:
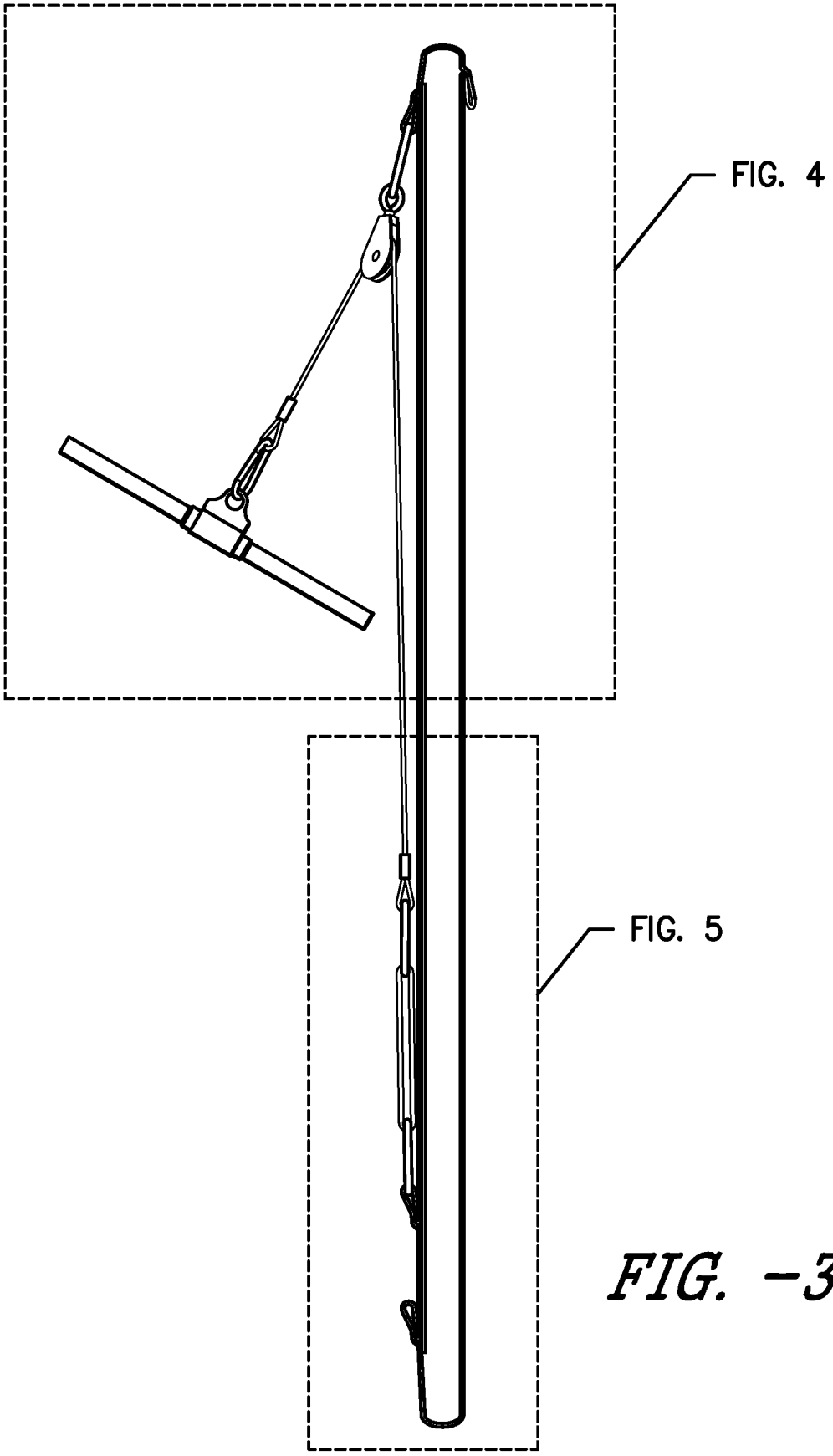
FIG. 3 is a side view of one embodiment of a weight sled apparatus in accordance with one aspect of the present invention.
Figure 4:
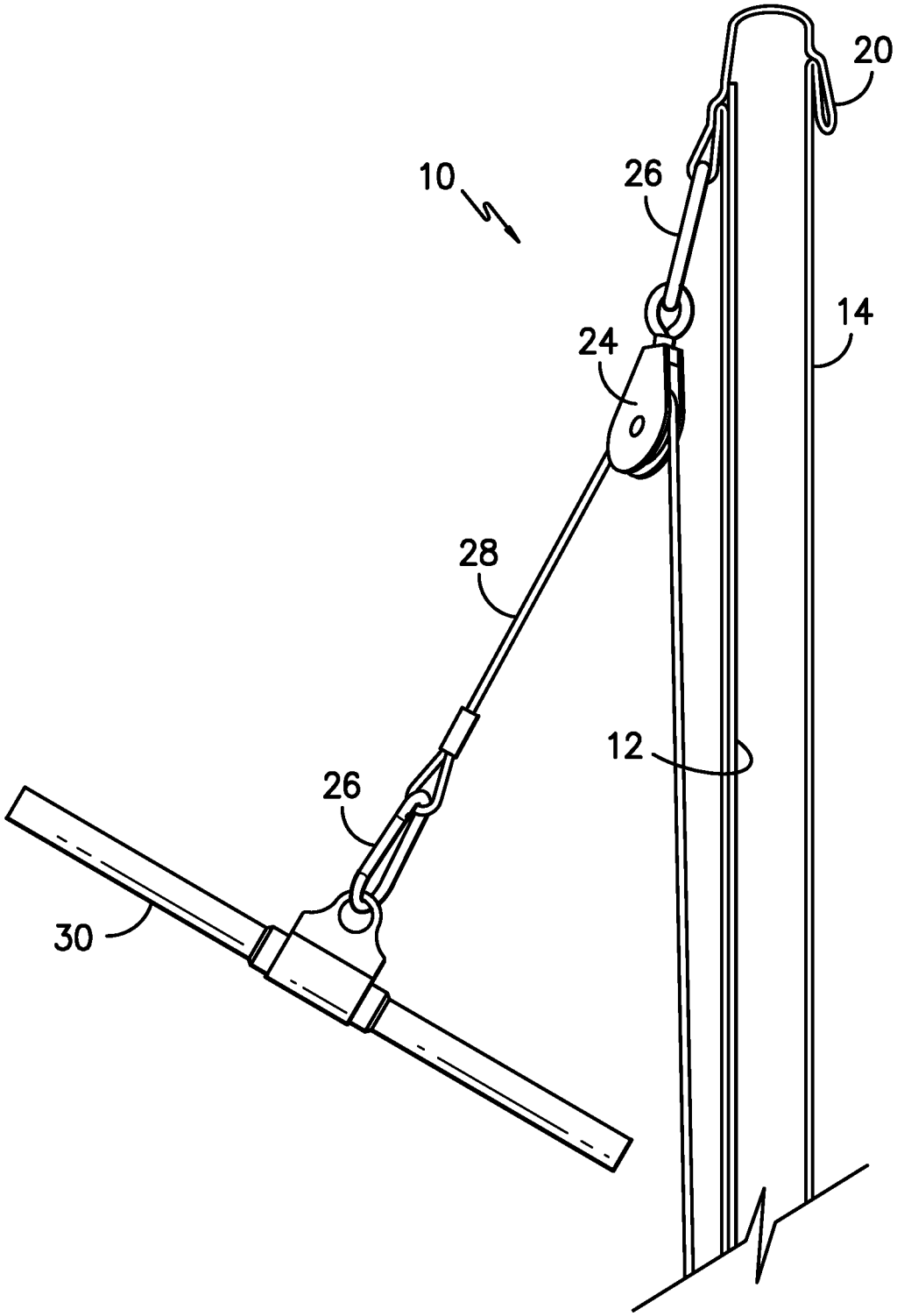
FIG. 4 is a perspective view of the top portion of one embodiment of a portable door mounted exercise apparatus in accordance with one aspect of the present invention.
Figure 5:
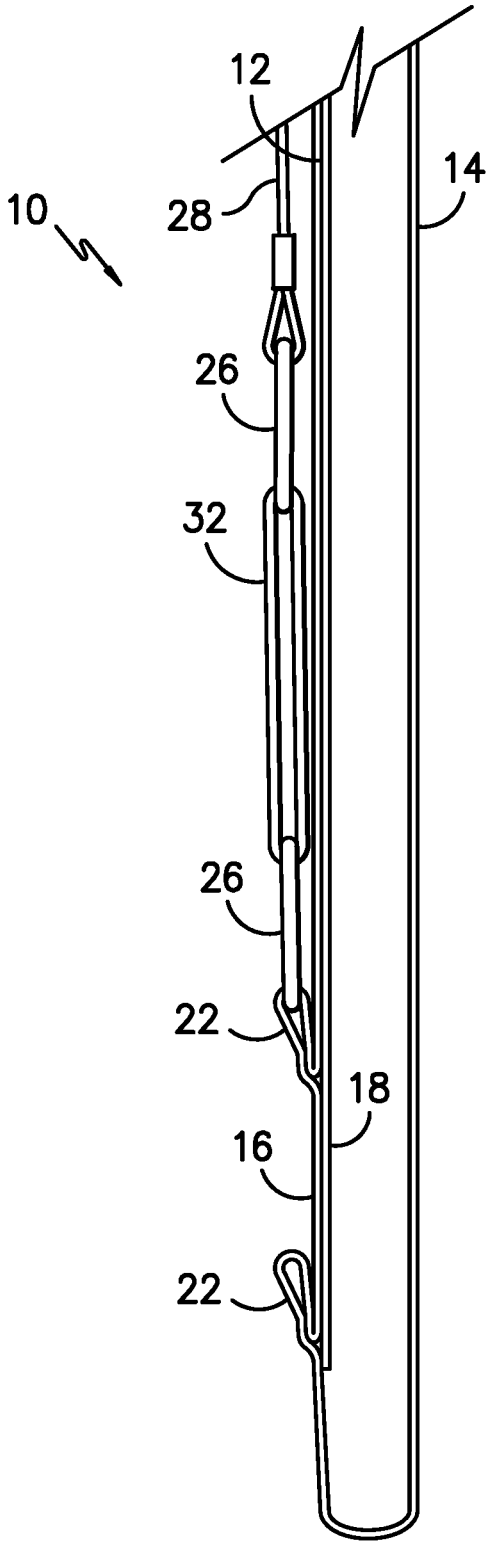
FIG. 5 is a perspective view of the bottom portion of one embodiment of a portable door mounted exercise apparatus in accordance with one aspect of the present invention.

The portable exercise apparatus 10 is preferably configured to include several anchor points 22 for attachment of various components. In a preferred embodiment, anchor points are formed by fabric from the back strap 14 being folded back on itself to form a loop. Anchor points 22 may include a first loop disposed on the top portion of the front strap 12 for attaching a pulley, and a second and third loop attached to the bottom portion of the back strap 14, as shown, for attachment to an elastic resistance band, either directly or via an intervening carabiner, clip, or the like. When the portable exercise apparatus 10 is mounted on a door and in use, the anchor points 22 are attached to the side of the portable exercise apparatus 10 facing the user, as shown in FIGS. 1 and 2.

Cable/Pulley Assembly

In one embodiment, a pulley 24 is removably attached to the top anchor point 22 disposed on the top portion of the front strap 12 by an attachment means 26, such as a carabiner, O-ring, D-ring, or the like, and a cable 28 runs through the pulley 24 so that the handle members hang freely at a first end of the cable, and so that the second end of the cable is operatively attached to a resistance band via a carabiner, clip, or the like. The free end of the cable 28 preferably includes one or more handles 30 removably attached thereto using a carabiner or other suitable attachment means 26. Various types of handles 30 may be used interchangeably, and can be used for different types of exercises.

In a preferred embodiment, resistance bands 32 are removably attached to one of the anchor points 22 disposed on the bottom portion of the back strap 14 by a carabiner or other suitable attachment means 26. The resistance bands 32 can be removably attached to either of the lower anchor points 22 disposed on the bottom portion of the back strap 14 depending on the size of the door being used.

In use, a user removably attaches the desired resistance band 32 to the second end of the cable 28, and to a carabiner or clip that is attached to one of the bottom anchor points. One resistance band 32 can be used, or multiple bands can be used at a time to accommodate various strength levels. Exercises may include tricep, back, bicep, and upper back exercises by pulling the handle 30 up, down, etc. Other types of exercises may be employed, as well.

When the portable exercise apparatus 10 is not in use, the pulley 24, cable 28, attachment means 26, and resistance bands 32 can be removed from the door, and the front strap 12 and back strap 14 can be folded or rolled up for storage and transportation purposes. It is contemplated that the portable exercise apparatus 10 may be transported and/or stored in a duffel bag, sport bag, or the like.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. A portable exercise apparatus for mounting on a door comprising:

a front strap having a top portion and a bottom portion;

a back strap having a top portion and a bottom portion, further including a first anchor point attached to said top portion of said back strap, and a second anchor point attached to a bottom portion of said back strap;

said bottom portion of said back strap and said bottom portion of said front strap further including complementary attachment means so that said bottom portion of said back strap may be removably attached to said bottom portion of said front strap;

a pulley operatively attached to said first anchor point;

a cable member having a first end and a second end;

a handle member removably attached to said first end of said cable member;

a first resistance band removably and operatively attached to said second end of said cable member, and wherein said resistance band is also removably and operatively attached to said second anchor point;

wherein said cable member feeds through said pulley so that said handle member hangs freely, and so that pulling said handle member downwardly or outwardly away from said pulley causes said resistance band to stretch.

2. The portable exercise apparatus set forth in claim 1, further including a stop member, wherein said stop member is operatively attached to said upper portion of said back strap so that said stop member prevents said front and back straps from rotating about said door when said exercise apparatus is in use.

3. The portable exercise apparatus set forth in claim 1, further including a second resistance band that may be used interchangeably, or along with, said first resistance band during use.

* * * * *